US008701692B2

(12) United States Patent
Holland et al.

(10) Patent No.: US 8,701,692 B2
(45) Date of Patent: Apr. 22, 2014

(54) COLLAPSIBLE PORTABLE SHELTER

(75) Inventors: Allen Holland, Sheffield (GB); Thomas A. Quinn, Carlsbad, CA (US)

(73) Assignee: Pro Performance Sports, L.L.C., Carlsbad, CA (US)

( * ) Notice: Subject to any disclaimer, the term of this patent is extended or adjusted under 35 U.S.C. 154(b) by 0 days.

(21) Appl. No.: 13/458,528

(22) Filed: Apr. 27, 2012

(65) Prior Publication Data

US 2013/0284225 A1 Oct. 31, 2013

(51) Int. Cl.
*E04H 15/50* (2006.01)
*E04H 15/38* (2006.01)

(52) U.S. Cl.
USPC ..... 135/145; 135/122; 135/131

(58) Field of Classification Search
USPC ..... 135/122, 123, 131, 143, 144, 145, 147
See application file for complete search history.

(56) References Cited

U.S. PATENT DOCUMENTS 3,448,748 A * 6/1969 Walrave ..... 135/127
4,641,676 A 2/1987 Lynch
4,779,635 A 10/1988 Lynch
5,421,356 A 6/1995 Lynch
6,112,757 A * 9/2000 Tseng ..... 135/145
6,283,136 B1 * 9/2001 Chen ..... 135/144
7,367,348 B2 * 5/2008 Tsai et al. ..... 135/145
2003/0213513 A1 11/2003 Eriksen et al.
2006/0174929 A1 * 8/2006 Tseng ..... 135/159
2007/0051397 A1 * 3/2007 Choi ..... 135/131
2007/0221262 A1 * 9/2007 Tsai et al. ..... 135/145
2011/0073148 A1 * 3/2011 Choi ..... 135/145

OTHER PUBLICATIONS

The Coleman Company, Inc., "Shelter Setup Instructions" for Model 2000004407 (2009).

* cited by examiner

*Primary Examiner* — David R Dunn
*Assistant Examiner* — Danielle Jackson
(74) *Attorney, Agent, or Firm* — Kenneth H. Ohriner; Perkins Coie LLP

(57) ABSTRACT

A collapsible shelter includes an improved attachment of the roof poles to the legs. A shelter frame has a leg at each corner. Each leg may have an angled top edge or surface. A scissor assembly attaches adjacent legs to each other. An offset link pivotally attaches the roof poles to the legs, adjacent to the top of each leg. The roof poles can be rigidly attached to the offset link. Extension poles are attached to the roof poles with a bungee or similar elastic element.

11 Claims, 5 Drawing Sheets

COLLAPSIBLE PORTABLE SHELTER

BACKGROUND OF THE INVENTION

The invention relates to collapsible or folding frame shelters. Collapsible shelters typically have a metal framework covered by a fabric canopy. Although various frameworks have been used, they all generally have telescopically extending legs that support a folding truss made up of pivotally interconnected links. The truss can be expanded from a compact storage and transport position into an extended position for holding up the fabric canopy. Roof poles are typically pivotally attached to the legs, with the roof poles directly supporting the fabric or other material used for the canopy. Since collapsible shelters are relatively lightweight and easily carried, they are often used to provide shade, and also limited protection from wind and rain, in various outdoor locations, such as beaches, picnic areas, outdoor swap meets, etc. While different collapsible shelters have been used with varying degrees of success in the past, there remains a need for improved collapsible shelters.

SUMMARY OF THE INVENTION

A new collapsible shelter has now been invented. This new design includes an improved attachment of the roof poles to the legs, providing a sturdy yet compact collapsible shelter having an aesthetic roof line. In one example, this new shelter includes a frame having a leg at each corner. Each leg may have an angled top edge or surface. A scissor assembly may attach adjacent legs to each other. An offset link may be used to pivotally attach the roof poles to the legs, adjacent to the top of each leg. The roof poles can be rigidly attached to the offset link.

The frame is movable from a folded position where the roof poles are substantially parallel to the legs, to an unfolded position where the roof poles extend radially outwardly and are oriented at an angle to the ground of zero to about 45 degrees. Extension poles may be used to extend the covered area. An extension pole may extend outwardly from each roof pole, and be attached to the roof pole via an elastic cord. A fabric canopy covers the top of the frame. Optionally, one or more separate fabric pieces may be attached to the legs, to provide a wind or privacy screen.

Other objects and features are set forth in the following detailed description and drawings which provide an example of the present collapsible shelter. The detailed description is provided by way of example and is not intended to be a statement of the limits of the invention.

BRIEF DESCRIPTION OF THE DRAWINGS

In the drawings, the same element number indicates the same element in each of the views.

DETAILED DESCRIPTION OF THE DRAWINGS

Figure 1:
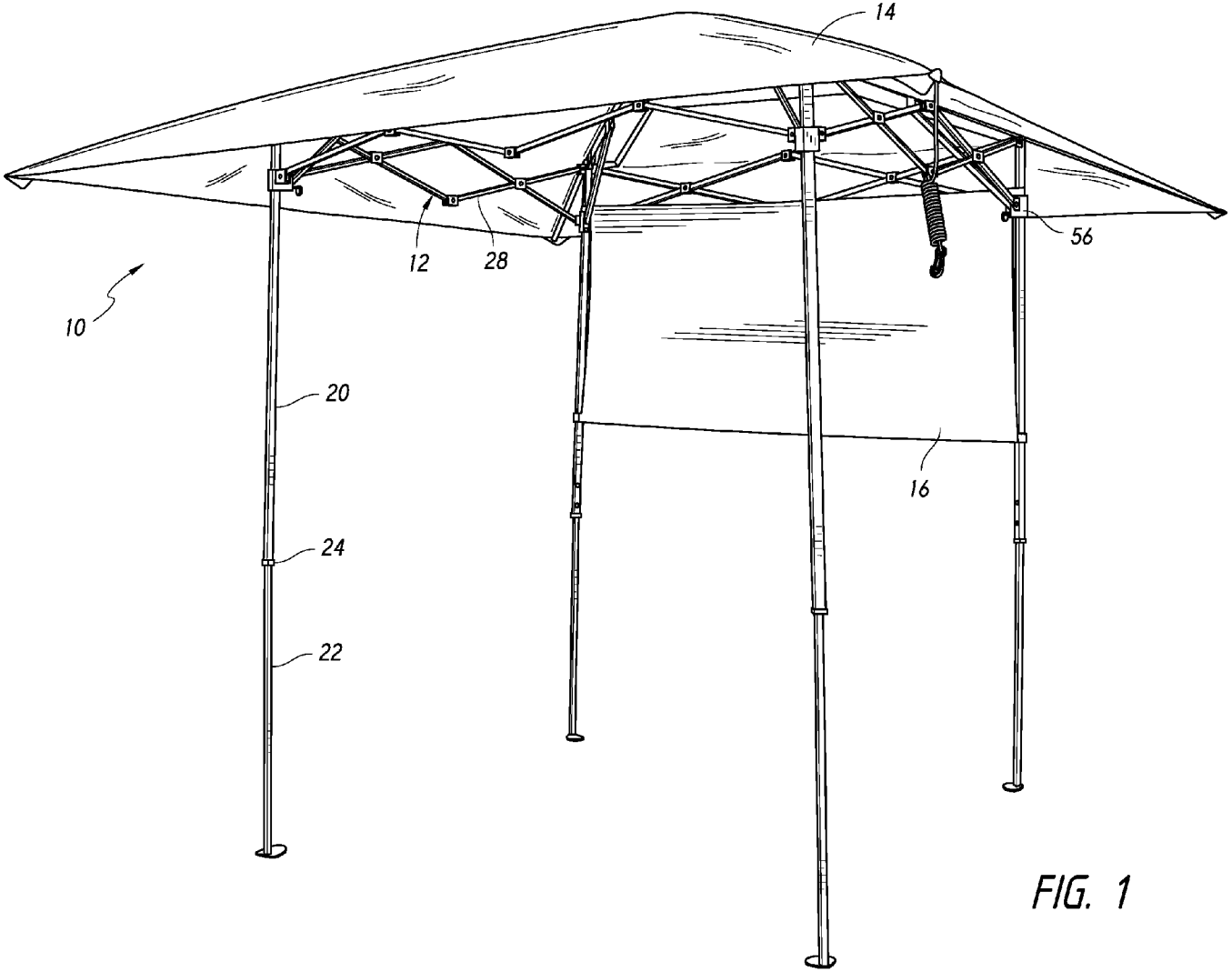
FIG. 1 is a perspective view of the new collapsible shelter of the invention.
Figure 2:
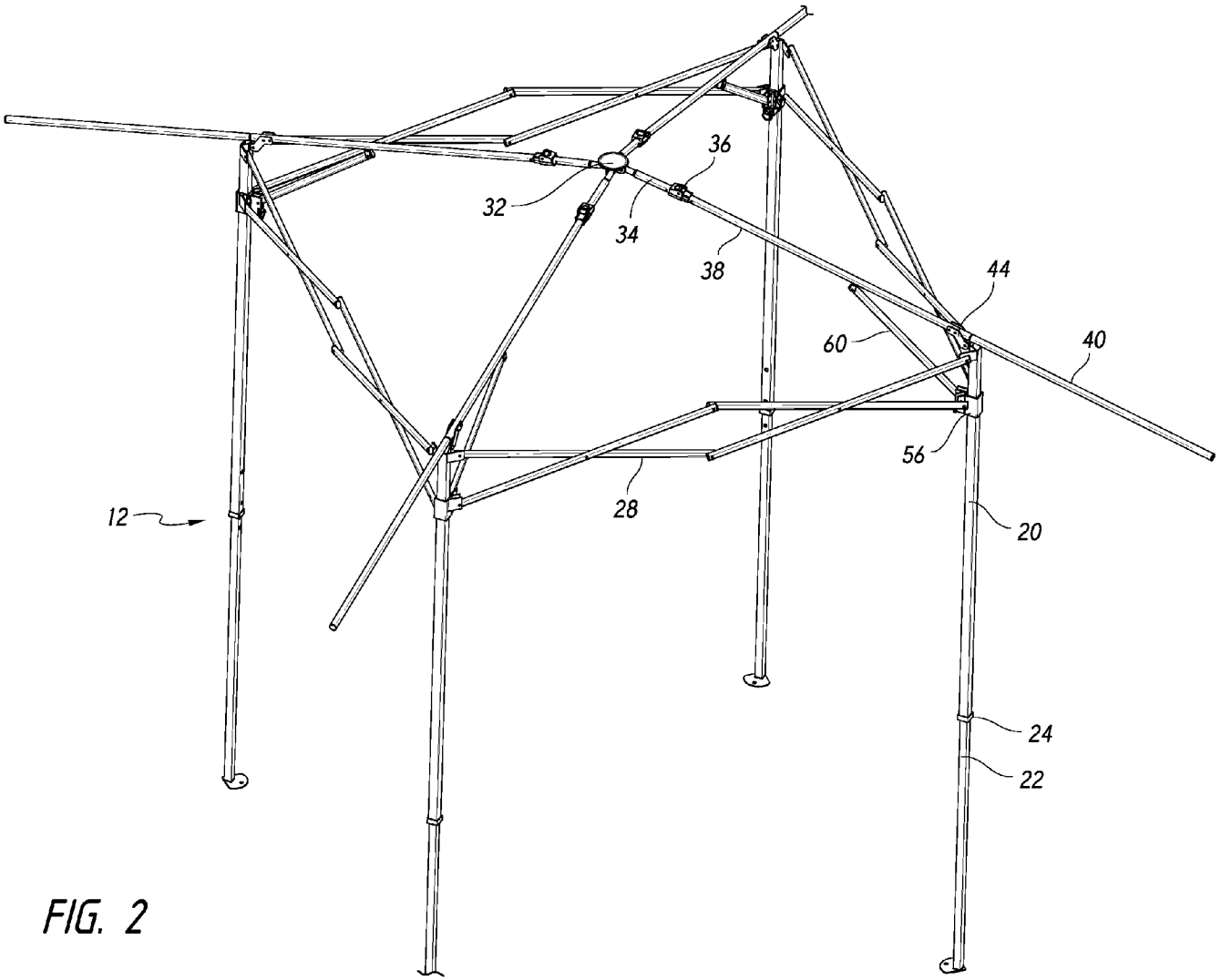
FIG. 2 is a perspective view of the frame of the collapsible shelter shown in FIG. 1.
Figure 3:
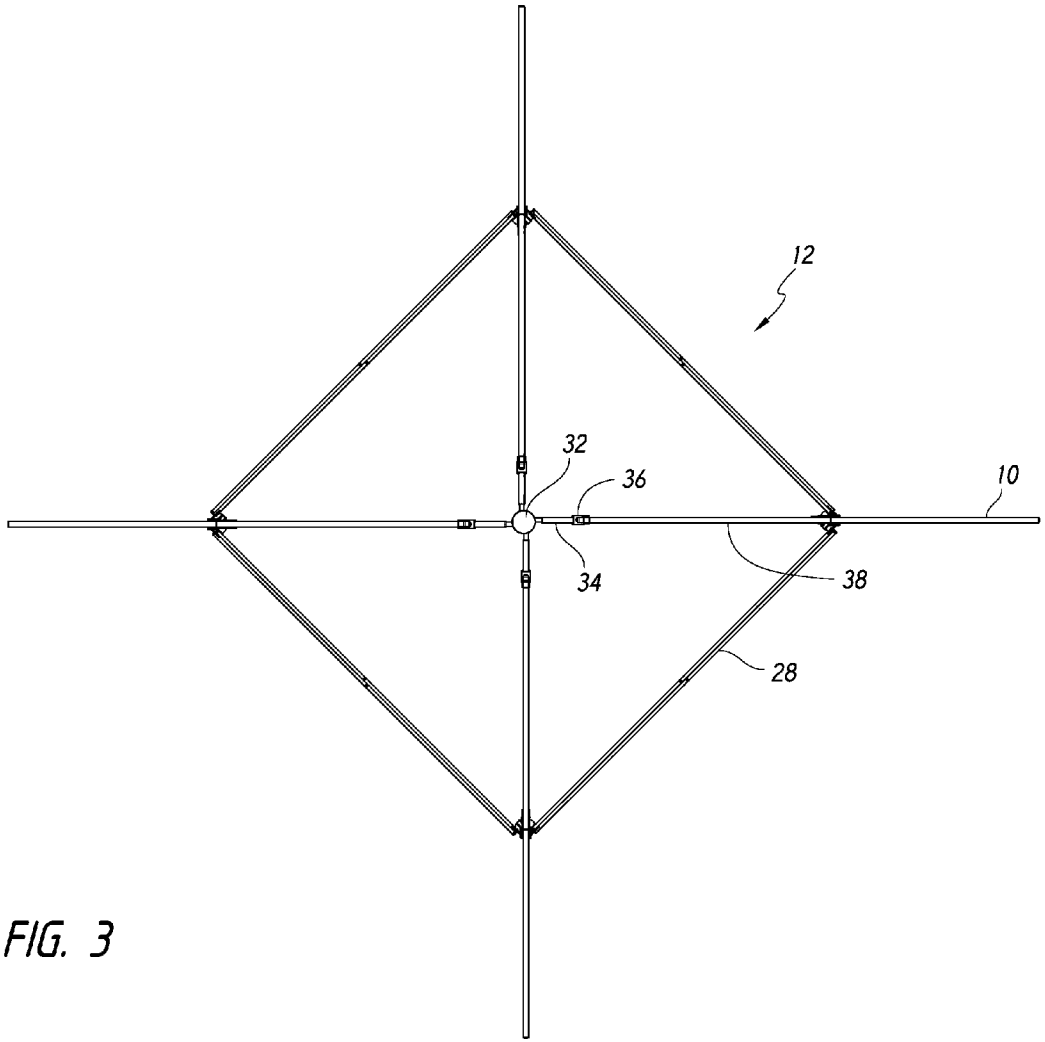
FIG. 3 is a top view of the frame shown in FIG. 2.

As shown in FIGS. 1 and 2, a collapsible shelter 10 has a fabric canopy 14 supported on a frame 12. One or more optional wind or privacy screens 16 may be attached to the vertical legs of the frame. Each leg may have an upper leg pole 20 telescopically attached to a lower leg pole 22. The leg pole telescopic positions may be selected and then locked using a locking collar 24. The locking collar 24 may have a spring biased pin extendible through holes in the leg poles, to allow varying amounts of extension to be selected, and also to allow the lower leg pole 20 to slide substantially entirely into the upper leg pole, to place the shelter into a folded storage and transport position.

The drawings show a design having four corners and four legs. Other designs having six, eight, or more legs may also be used. The frame 12 described here is symmetrical side-to-side and front-to-back. Consequently the arrangement of components is the same at each of the four corners or four sectors of the frame. However, this similarity is not a design requirement.

Figure 4:
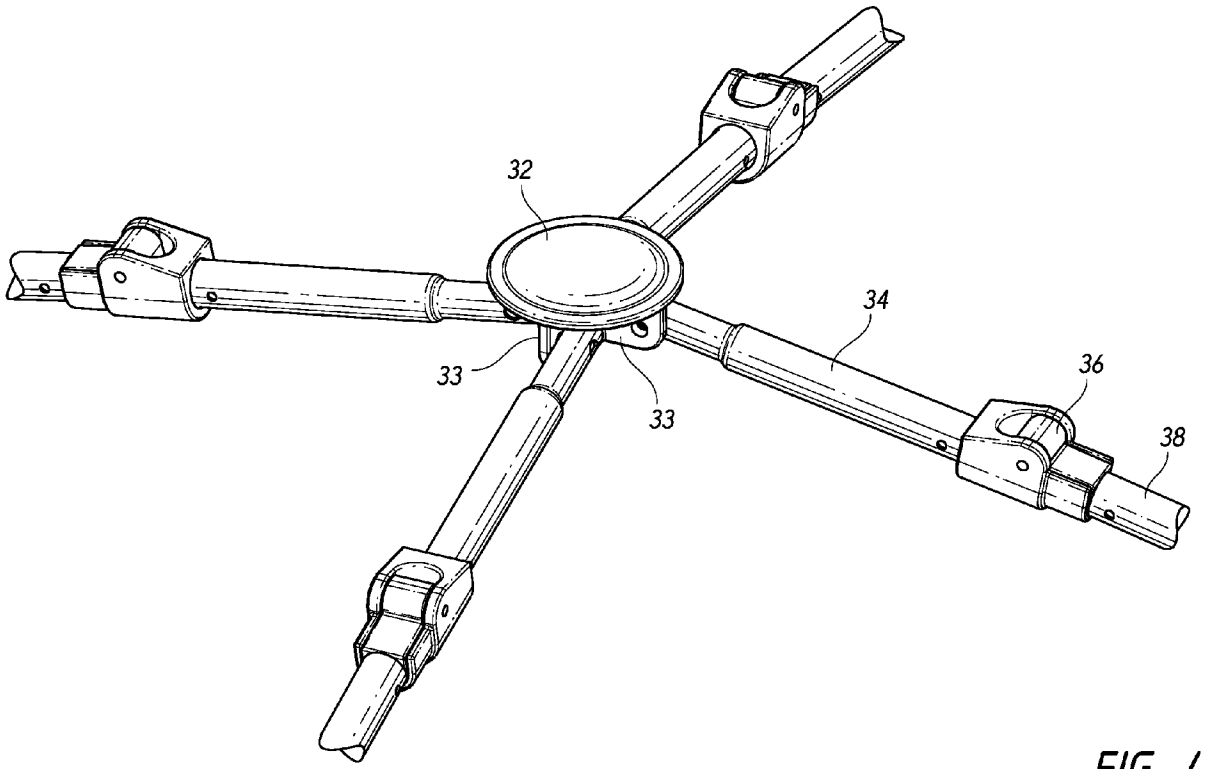
FIG. 4 is a perspective view of the roof cap of the frame shown in FIG. 2.

As shown in FIG. 2, a scissor assembly 28 is connected to adjacent upper leg poles. The scissor assembly includes pivotally connected segments, with the outer ends of the segments attached to a movable slide fitting 56 and to a fixed top fitting 58 on the upper leg pole. Referring now also to FIG. 4, roof poles 38 extend radially outwardly from fold joints 36 on inner segments 34 pivotally attached to a central roof cap 32. A brace 60 may be pivotally attached to the roof pole 38 and to the slide fitting 56, to provide a stronger frame.

Figure 6:
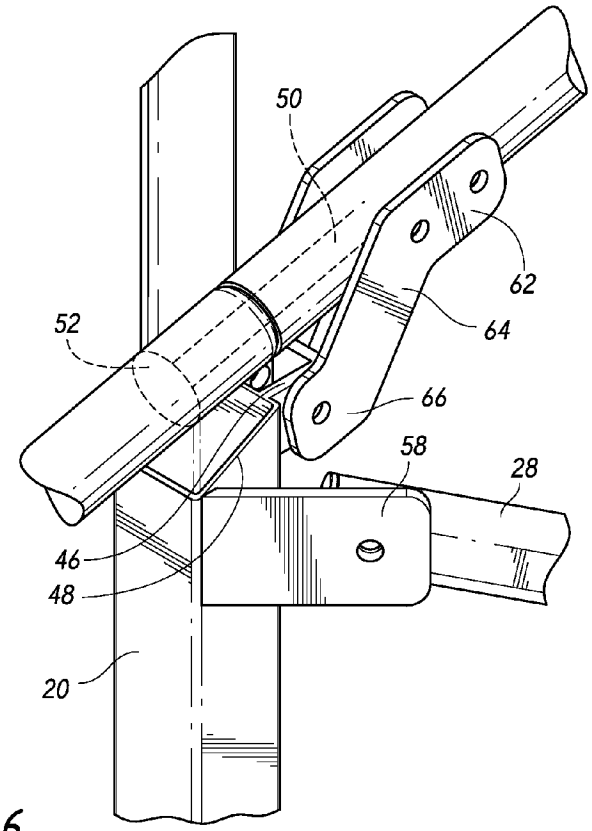
FIG. 6 is a right side perspective of the design shown in FIG. 5.
Figure 5:
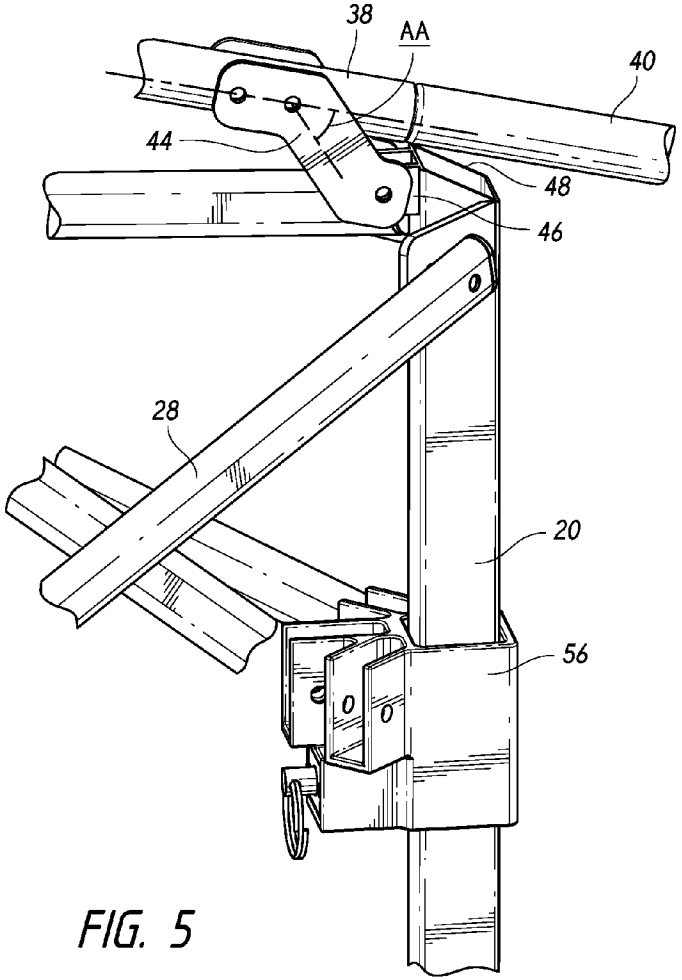
FIG. 5 is a left side perspective view of an upper leg pole and an attachment of a roof pole to the upper leg pole, as shown in FIG. 2.

Turning to FIGS. 5 and 6, the upper leg pole 20 has an angled top end or surface 48 which runs uphill towards the center of the frame. In general the top end 48 is at an angle of about 15 to 45 degrees from horizontal. The outer end of the roof pole 38 is rigidly attached to an inner end of a pair of offset plates or links 44. The outer end of the links 44 is pivotally attached to a bracket at the top of the upper leg pole 20. An extension pole 40 may be attached to the outer end of the roof pole 38. The inner end of the extension pole 40 may have a reduced diameter, or an end fitting, that slides into or onto the outer end of the roof pole 38. A bungee cord 50 or other elastic element may extend out of the roof pole 38 and attach to the extension pole 40, for example with the cord 50 joined to a plug 52 inside of the extension pole 40.

As shown in FIGS. 5 and 6, the link 44 has an upper straight segment 62, an angled segment 64 and a lower straight segment 66. The straight segments 62 and 64 may be parallel to each other, with the angled segment at an angle of 20 to 60 degrees relative to the straight segment. The link 44 pivotally attaches the outer end of the roof pole 38 to the top end of the upper leg pole 20. With the frame in the fully unfolded or erect position as shown in FIGS. 5 and 6, the outer end of the roof pole 38 is positioned over the top end 48 of the upper leg pole 20. The outer end of the roof pole 38 may also be centered over the upper leg pole 20. The outer end of the roof pole 38 is also substantially parallel to the angled top end 48 of the upper leg pole 20. Optionally, the outer end of the roof pole 38 may contact the top end 48, with the top end 48 providing a hard stop against further pivoting movement.

Although the drawings show the link 44 as a pair of offset plates, a single offset plate may also be used. The link 44 may also be provided in the form of a bar, rod, hinge, etc. instead of a plate.

Thus, a novel collapsible shelter has been shown and described. Various changes and modifications may of course be made without departing from the spirit and scope of the invention. The invention, therefore, should not be limited except by the following claims, and their equivalents.

The invention claimed is:

1. A collapsible canopy comprising:

a frame having four corners and including at each corner:

a leg a scissor assembly attaching the leg to another leg and having pivotally connected first and second segments, with an outer end of the first segment attached to a movable slide fitting on the leg, and an outer end of the second segment pivotally attached to the leg at a first position;

an offset link having a lower end pivotally attached to the leg above the first position;

a roof pole rigidly attached to an upper end of the offset link, with the roof pole not pivotable to any portion of the offset link;

an extension pole extending outwardly from each roof pole;

with the frame movable from a folded position wherein the roof poles are substantially parallel to the legs, to an unfolded position; and a fabric canopy on the frame.

2. The collapsible canopy of claim 1 further comprising an inward facing bracket at the top of each leg, with the offset link pivotally attached to the bracket.

3. The collapsible canopy of claim 1 with the offset link at each corner comprising first and second offset plates each having a straight upper segment parallel and attached to the roof pole, an angled segment joined to the straight upper segment, and a lower straight segment offset below the roof pole, with the lower straight segment pivotally attached to the leg.

4. The collapsible canopy of claim 1 wherein at each corner, the extension pole has an end fitting slidable into an open outer end of the roof pole.

5. The collapsible canopy of claim 4 wherein at each corner, the extension pole is attached to the roof pole with an elastic cord.

6. The collapsible canopy of claim 1 with the lower end of the first offset link pivotally attached to the top end of the first leg.

7. A collapsible canopy comprising:

a folding frame;

a leg at each corner of the frame, with each leg having an angled top edge;

at least one offset link having a lower end pivotally attached to each leg adjacent to the angled top edge of each leg, and an upper end rigidly attached to a roof pole, with the roof pole not pivotable to any portion of the offset link;

an extension pole attached to each roof pole;

with the extension pole at each corner positioned over, and parallel to, the angled top edge of the leg; and a sheet material on the folding frame.

8. The collapsible canopy of claim 7 with the lower end of the offset-link spaced vertically apart from the upper end of the offset link by a dimension substantially equal to a diameter of the roof pole.

9. The collapsible canopy of claim 7 with the angled top edge at an angle ranging from 10 to 30 degrees from horizontal.

10. The collapsible canopy of claim 7 with an outer end of the roof pole aligned within 0.5 inches of an outer edge of the lower end of the offset link.

11. A collapsible canopy comprising:

a frame having four corners, and including at each corner: a leg having a top end, a scissor assembly attaching the leg to an adjacent leg, an offset link having a lower end pivotally attached to the leg adjacent to the top end of the leg;

a roof assembly including four roof poles with, at each corner, a roof pole rigidly attached to an upper end of the offset link, an extension pole extending outwardly from the roof pole, and the extension pole having an end fitting slidable into an open outer end of the roof pole;

with the frame movable from a folded position wherein the roof poles are substantially parallel to the legs, to an unfolded position wherein at each corner an extension pole extends over the top end of a leg; and a fabric canopy on the frame.

* * * * *